US005188371A

United States Patent [19]

Edwards

[11] Patent Number: 5,188,371

[45] Date of Patent: Feb. 23, 1993

[54] REUSABLE PROJECTILE IMPACT REFLECTING TARGET FOR DAY OR NIGHT USE

[76] Inventor: A. W. Edwards, 10161 Wales Loop #218, Bonita Springs, Fla. 33923

[21] Appl. No.: 890,091

[22] Filed: May 29, 1992

[51] Int. Cl.[5] ..... F41J 5/00

[52] U.S. Cl. ..... 273/378

[58] Field of Search ..... 273/378, 408, 409

[56] References Cited

U.S. PATENT DOCUMENTS

| | | | |
|---|---|---|---|
| 1,145,585 | 7/1915 | Hebard | 273/378 |
| 1,175,692 | 3/1916 | Boicourt | 273/378 |
| 3,330,561 | 7/1967 | Kandel | 273/378 |
| 3,353,827 | 11/1967 | Dun, Jr. | 273/378 |
| 3,370,852 | 2/1968 | Kandel | 273/378 |
| 3,423,092 | 1/1969 | Kandel | 273/378 |
| 3,895,803 | 7/1975 | Loe | 273/378 |
| 3,899,175 | 8/1975 | Loe | 273/378 |
| 4,462,598 | 7/1984 | Chalin et al. | 273/378 |

*Primary Examiner*—William H. Grieb

*Attorney, Agent, or Firm*—William F. Hamrock

[57] ABSTRACT

A reuseable projectile impact reflecting target for day and night use, and more particularly to a target with a replaceable primary target label including a polypropylene film containing a colored ink target image from which the ink is removed at the point of projectile impact exposing a contrasting colored photoreflective ultraviolet pigmented ink on the surface to increase visibility.

14 Claims, 4 Drawing Sheets

REUSABLE PROJECTILE IMPACT REFLECTING TARGET FOR DAY OR NIGHT USE

BACKGROUND OF THE INVENTION

1. Field of the Invention

The present invention generally relates to a reusable projectile impact reflecting target for day and night use, and more particularly to a target with a replaceable primary target label including a polypropylene film containing a colored ink target image from which the ink is removed at the point of projectile impact exposing a contrasting colored photoreflective ultraviolet pigmented ink on the under surface to increase visibility.

2. Description of the Prior Art

Ballistic targets for firearms are well known in the prior art. Among the many problems therewith include that the projectile holes in the target are difficult to see, and that repeated projectile penetrations of the primary target area at the bulls eye, limit the service life of the target. Hence many ballistic targets have been developed with improved means to visually see a bright marking at the projectile point of entry, but have proved to be cumbersome and expensive to produce, and they have not addressed the problems of limited target service life, and night usage.

U.S. Pat. No. 3,895,803 discloses a colored backing sheet covered with a transparent plastic sheet having a target pattern thereon whereby the plastic sheet is permanently bonded to the backing sheet and the entire target has to be replaced after a number of [bullet hole] projectile penetrations.

None of the prior art provides a ballistic target for firearms as herein provided, which provides a primary target label which can be replaced after a number of projectile penetrations, utilizing the original base material, and at the same time provides a projectile penetrated surface which is easily visible both day and night.

SUMMARY OF THE INVENTION

It is a object of the present invention to provide a ballistic target for firearms having a replaceable primary target surface which can be replaced while the support backing is still in good condition.

It is a further object of the invention to provide a replaceable target for firearms which provides a projectile penetration reflective target surface which is easily visible.

It is another object of the invention to provide a target which will indicate projectile impact under normal lighting, as well as low light level conditions.

It is another further object of the invention to reduce the amount of environmentally wasteful material by virtue of its reusable feature.

It is also an objective of the invention that the method of manufacturing is highly cost effective and efficient, resulting in a substantial lowering of unit cost compared with prior art.

The reuseable projectile impact reflecting target of the present invention includes a target base and a primary target label. The target base contains a material substantially forming an overall target shape. The primary target label includes a bottom paper layer having a colored photoreflective ink on its forward surface, and a pressure sensitive adhesive on its rear surface so that the target label can be releasably attached to the target base. The target label also includes a polypropylene film layer having a target image imprinted with ink on its front surface but no securely bonded thereto. The imprinted ink contrasts in color with the photoreflective ink on the bottom paper layer. A pressure sensitive adhesive on the back surface of the polypropylene film permits it to be attached to the bottom paper layer. When the polypropylene film is attached thereto, the photoreflective ink on the paper layer is totally concealed by the contrasting colored ink on the polypropylene film except for concentric rings and ring numbers on the target image resulting from reverse printing of the target image. The concentric rings and ring numbers assist in seeing the target image by exposing the photoreflective ink on the paper layer. The penetration of a projectile through the primary target label causes the contrasting colored ink on the polypropylene film to be removed, thereby exposing a clear area larger than the penetration point of the projectile thereon, causing the colored photoreflective ink surface on the bottom paper layer to show through the transparent projectile impact zone on the polypropylene film.

BRIEF DESCRIPTION OF THE DRAWINGS

Although such novel features believed to be characteristic of the invention are pointed out in the claims, the invention and the manner in which it may be carried out may be further understood by reference to the following disclosure and to the accompanying drawings.

DESCRIPTION OF THE PREFERRED EMBODIMENT

Figure 1:
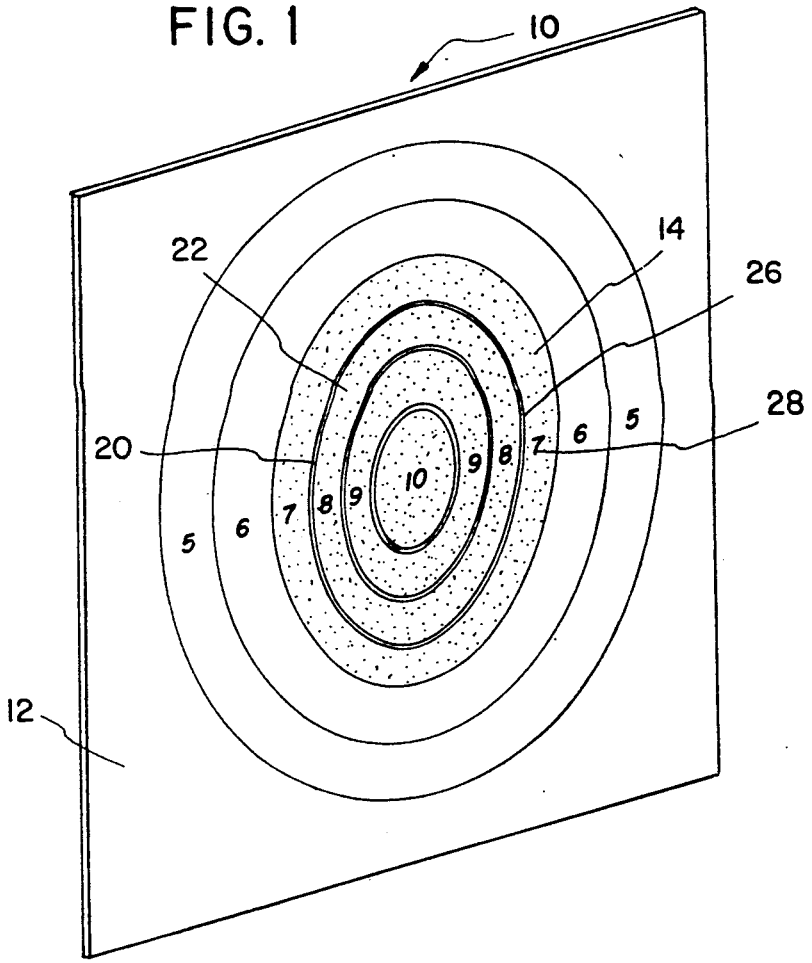
FIG. 1 is a perspective view of a preferred embodiment of the target of the invention showing the components of the target.

Referring to the drawings, and in particular FIG. 1, thereof, a preferred structure of the reusable projectile impact reflective target 10 of this invention is shown including the various components. The target base 12 is shown supporting the primary target label 14 which includes a bottom paper layer 16 and a top plastic film layer 18 shown in FIG. 7.

Figure 3:
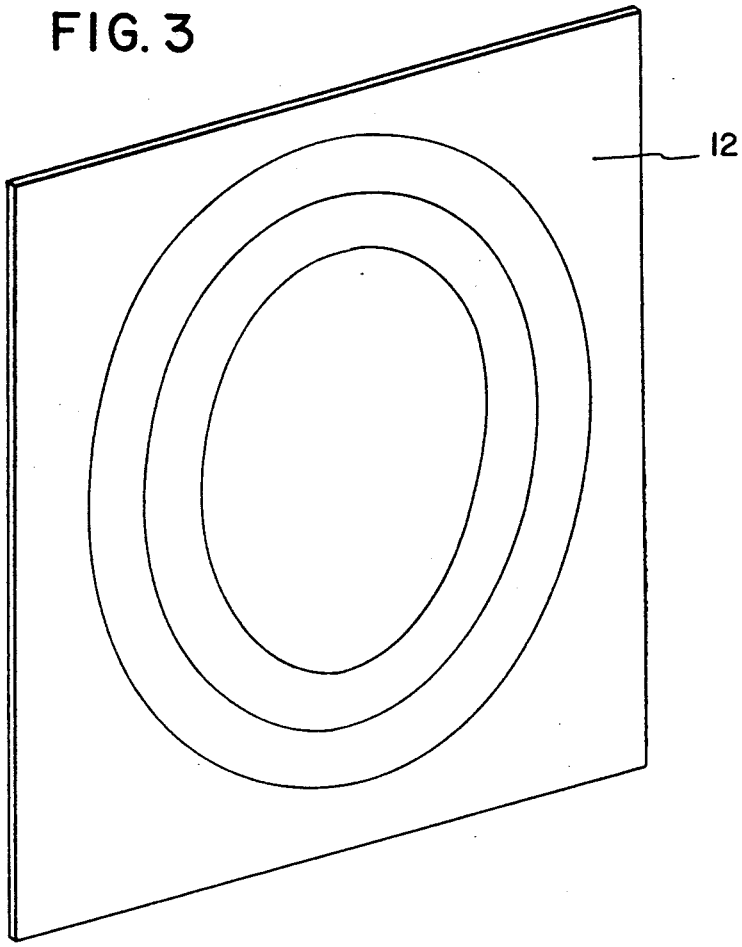
FIG. 3 is a view of the target base.

The principle element of target base 12 as seen in FIG. 3 is a square sheet of heavy weight paper, approximately 40–60 pound weight, having printed target alignment marks located on its outer surface.

Figure 4:
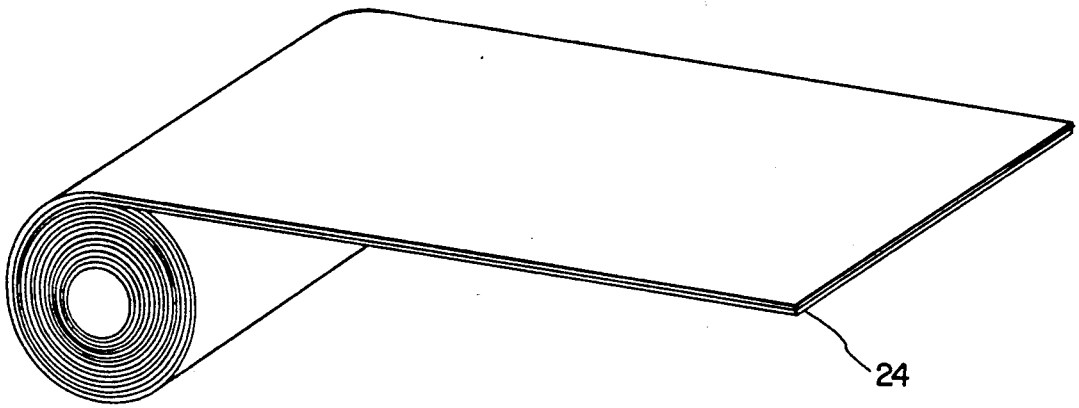
FIG. 4 is a view of the bottom layer of paper releasably mounted on its backing.

The bottom paper layer 16 of the primary target label 14 is a light weight sheet of paper of pressure sensitive stock which is releasably attached to a backing paper as seen in FIG. 4 which permits primary target label 14 to be releasably attached to target base 12. The lightweight pressure sensitive stock of paper layer 16 is a standard industrial item which is obtained as a pressure sensitive stock material releasably attached to a backing paper. A flat tint of light color photoreflective ink 20, such as fluorescent yellow which contains an ultraviolet responsive pigment, is printed on its surface. This is supplied for optimum production efficiency in a roll stock material.

Figure 5:
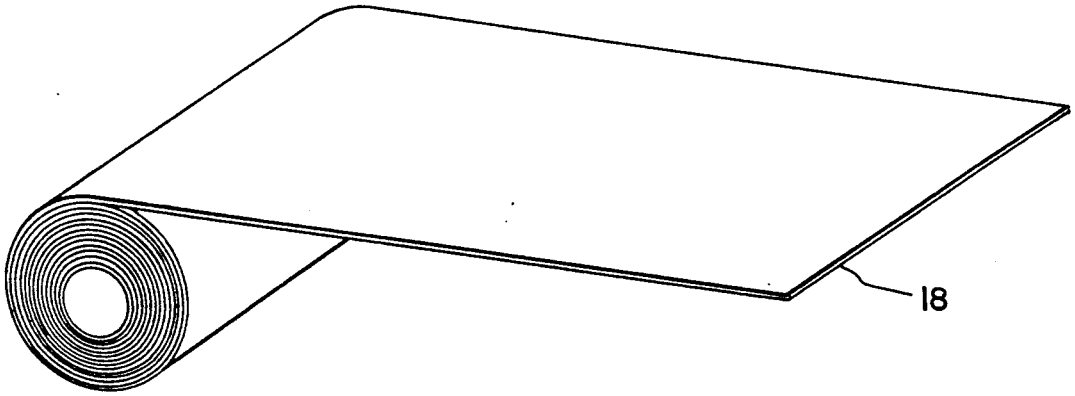
FIG. 5 is a view of the polypropylene film on its roll.

The layer of plastic film preferably includes a strip of polypropylene film 18 preferably a transparent biaxially oriented polypropylene film having a pressure sensitive rubber or acrylic base adhesive backing. This is also standard commercial item in roll form shown in FIG. 5 for optimum production efficiency. A strip of polypropylene film 18 is removed from the roll and is adhered to the photoreflective inked surface of the paper layer 16. Other plastic films such as polyethylene, polyacrylic, mylar and similar films maybe substituted for polypropylene.

A coating of a contrasting colored flat ink 22 which provides a sufficient degree of contrast between the primary target substrate photoreflective ink 20, to allow easy visual sighting of a projectile impact of penetration of the primary target objective, is then applied to the front surface of the polypropylene film 18. The colored flat ink 22 is applied by reverse printing in the form of a target image such as a bull's eye or similar target design.

Printing on top of the polypropylene film is a radical and novel departure from conventional film production. Prior art film laminate imprinting procedures generally require a top coat or print coat to the surface of the polypropylene film prior to printing thereon, to ensure that the printing on the film is adherent. The present invention has done exactly the reverse by deliberately omitting such a top or print coat on the film and printing thereon by reverse printing technique. The result is that the reverse print adheres well under ordinary conditions but is removed at the point of impact of a projectile. Such a result is totally unexpected in the present invention.

The target image printed on the surface of the polypropylene film layer 18 is reverse or a negative print. This means essentially that the non image areas are printed, and the actual image areas left unprinted, which creates a negative, or reverse image. By using the reverse image printing method on the polypropylene film layer 18, the design of the target's image bull's eye concentric rings 26 and the ring numbers 28 are highly visible because the photoreflective ink 20 is exposed through the unprinted portions of rings 26 and numbers 28 on the polypropylene film layer 18 as a result of the reverse printing procedure. Thus the additional advantage of this feature is that the photoreflective ink concentric rings 26 and ring numbers 28 which are integral parts of the bull's eye target design become primary sighting alignment aids by affording the user a high profile aiming pattern when using the target particularly in low light levels as a result of the ultraviolet reflectivity of the photoreflective ink 20. Applicant is not aware of any prior art directed to these improvements in targets. Prior art targets appear to relay on conventional reverse printing methods which do not produce this type of surface to assist the marksman in seeing the target especially under low light level conditions.

Figure 7:
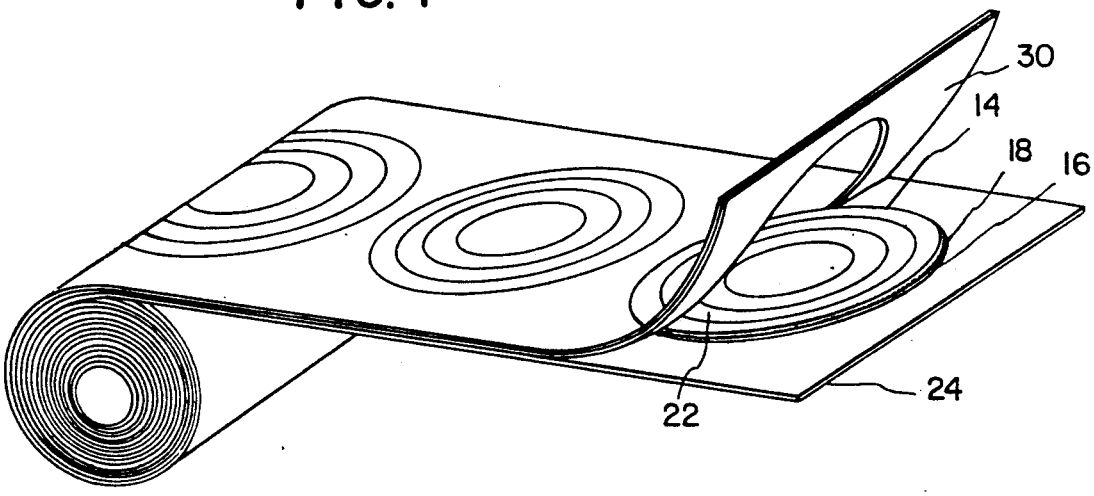
FIG. 7 is a view of the overlaminated die cut primary target being prepared
Figure 6:
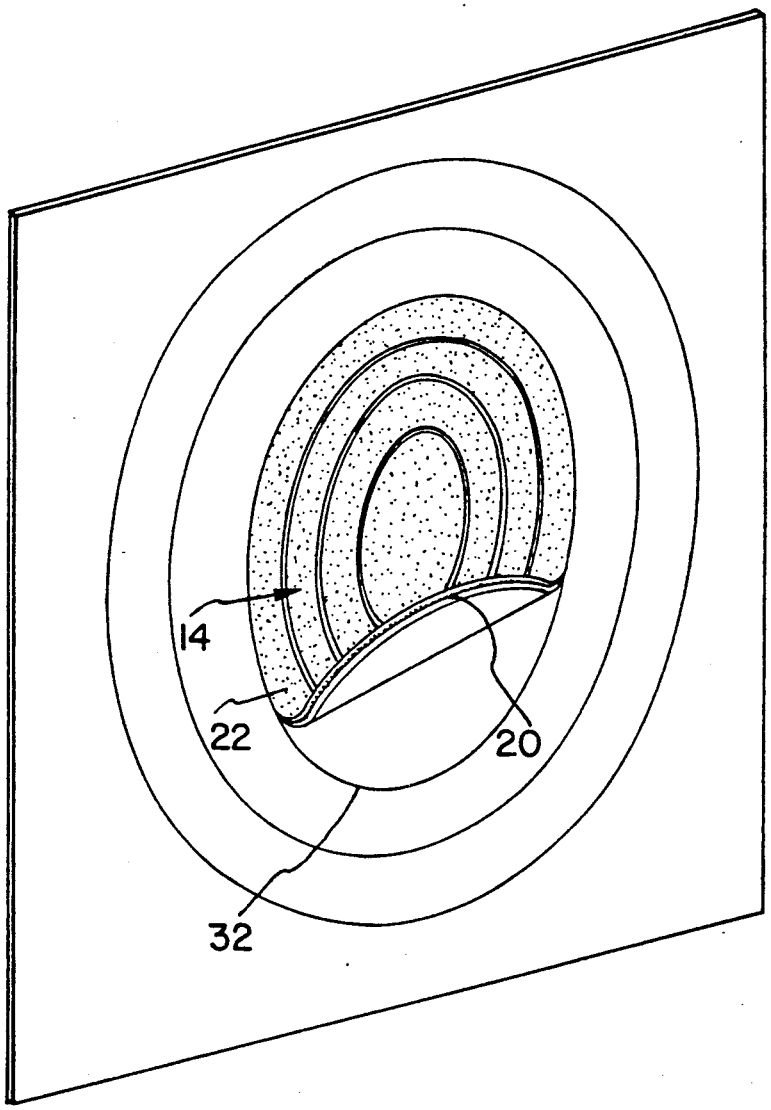
FIG. 6 is a view of the primary target label being removed from the target base.

Following the adherence of the polypropylene film layer 18 and the reverse printing thereon of the bull's eye or similar target design, a target shape is then die cut through the lamination material as seen in FIG. 7 to form the primary target label 14. The waste material 30, which is the lamination and label stock material surrounding the die cut shapes, is then removed from the backing paper 24. The target label 14 adhering to backing paper 24 now is ready to be applied to the target base 12. In doing so, the primary target label 14 is first removed from the backing paper 24 and is positioned on the predetermined alignment marks 32, usually the open central target area, located on the target base 12 as shown in FIG. 6.

Figure 2:
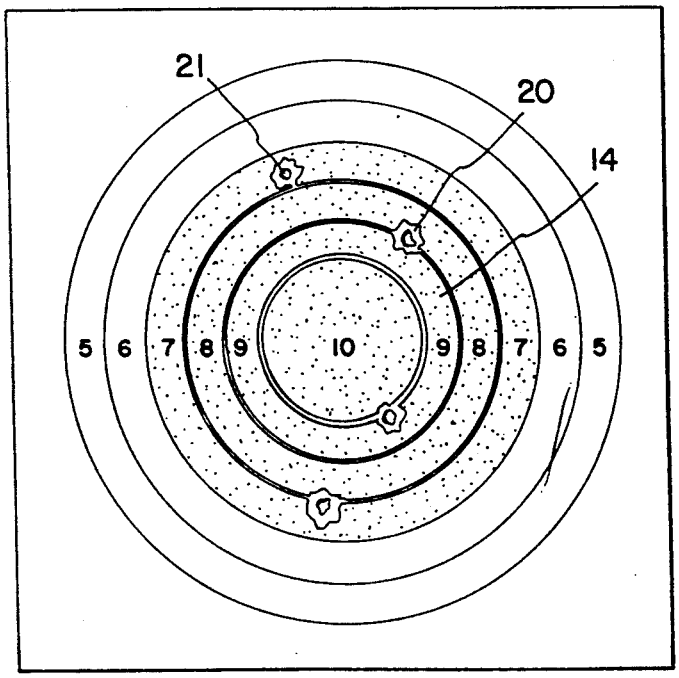
FIG. 2 is a view of a projectile penetration of the target according to the invention.

In operation of the invention, as seen in FIG. 2, when a projectile strikes the polypropylene film layer 18 of the primary target label 14, the shockwave of impact and penetration 21 cause the contrasting colored ink 22 in the immediate peripheral area of the projectile impact zone to be displaced, leaving an area larger than the profile penetration point from which the contrasting colored ink 22 has been removed. As the clear polypropylene film is uncovered in this area, the background of the photoreflective ink 20 is revealed and clearly visible. If the ultraviolet light pigment in the photoreflective ink of the primary target substrate is exposed during normal daylight conditions, a normal visual sighting occurs. During darkness or low light levels, ultraviolet rays generated by a typical commercial ultraviolet light source as manufactured by numerous electric supply companies under generic part numbers, as for example light fixture F4OT12/BLB, would be directed and aligned towards the primary target label mounted on the target base. The ultraviolet pigment revealed by projectile impact or penetration of the primary target label would be activated by the ultraviolet rays, thereby allowing a visual sighting of any direct hits. This target enhancement would be of particular interest to law enforcement and military agencies who must develop marksmanship and accuracy skills in low light level conditions.

After the primary target label 14 has been penetrated by numerous projectiles which would render the primary target label 14 incapable of identifying additional projectile impact points, the expended primary target label 14 may be either removed from the target base 12 backing sheet and replaced by a new primary target label 14, or alternatively, a replacement primary target label 14 may be affixed directly on top of the expanded primary target label 14. Replacement of the primary target label 14 will allow reuse of the target base 12 backing as long as it remains serviceable, at least a minimum of two or three rotations, substantially reducing the amount of waste generated, and total unit cost.

It will be further understood by those skilled in the target art that various modifications may be made in the target of this invention without departing from the spirit and scope of the invention.

What is claimed is:

1. A reusable projectile impact reflecting target for day or night use comprising in combination:

a target base and a primary target label, said target base comprising sheet of backing material substantially forming an overall shape, said target base having an outer surface with a target outline imprinted thereon, said primary target label comprising a bottom paper layer and a top plastic film layer, said bottom paper layer comprising a sheet of paper having a forward and a rear surface, said rear surface adapted to be releasably mounted within said target outline, said forward surface having a colored photoreflective ink thereon, said plastic film layer comprising a transparent strip of plastic having a front and back surface, said back surface, adapted to be mounted on said forward surface of said paper layer, said front surface defining a target image of contrasting colored image contrasting in color to the color of said photoreflective ink, said contrasting ink being adhered to said front surface but not being permanently bonded thereto, whereby when said primary target label is releasably mounted on said target base, the penetration of a projectile causes said contrasting colored ink to be removed from the plastic film layer front surface point of penetration exposing a clear area larger than the penetration point of the projectile, thereby exposing the photoreflective ink paper layer.

2. The target according to claim 1 wherein said primary target label can be demounted from said target base and can be replaced with a second primary target label.

3. The target according to claim 1 wherein a second primary target label can be releasably mounted on said primary target label.

4. The target according to claim 1 wherein said target image comprises photoreflective inked concentric rings and ring numbers.

5. The target according to claim 1 wherein said photoreflective ink is a light color.

6. The target according to claim 5 wherein said photoreflective ink includes an ultraviolet responsive pigment.

7. The target according to claim 1 wherein said target base comprises a sheet of heavy paper 40 to 60 pound weight.

8. The target according to claim 1 wherein said bottom paper layer comprises a light weight pressure sensitive stock releasably mounted on a backing paper to be demounted therefrom when mounted on said target base.

9. The target according to claim 1 wherein said plastic strip is polypropylene.

10. The target according to claim 9 wherein said polypropylene film layer comprises a biaxially oriented polypropylene.

11. The target according to claim 10 wherein said polypropylene film includes a pressure sensitive adhesive on its back surface to be mounted on said forward surface of the bottom paper layer.

12. The target according to claim 5 wherein said contrasting colored ink is a dark colored flat ink.

13. The target according to claim 12 wherein the color of said photoreflective ink is a fluorescent yellow.

14. The target according to claim 13 wherein said contrasting color flat ink forms a bull's eye.

* * * * *